US005547646A

United States Patent [19]

Drope

[11] Patent Number: 5,547,646

[45] Date of Patent: Aug. 20, 1996

[54] PROCESS FOR THE DECOMPOSITION OF CHROME ORE BY ALKALINE OXIDATION

[75] Inventor: Rüdiger Drope, Cologne, Germany

[73] Assignee: Bayer Aktiengesellschaft, Leverkusen, Germany

[21] Appl. No.: 377,580

[22] Filed: Jan. 24, 1995

Related U.S. Application Data

[63] Continuation-in-part of Ser. No. 260,865, Jun. 16, 1994, abandoned.

[30] Foreign Application Priority Data

Jun. 23, 1993 [DE] Germany ..... 43 20 707.3

[51] Int. Cl.[6] ..... C01G 37/00; C01G 37/14; C22B 34/30

[52] U.S. Cl. ..... 423/53; 423/61

[58] Field of Search ..... 423/61, 53, 596; 266/142, 173; 432/107, 112, 114

[56] References Cited

U.S. PATENT DOCUMENTS

| | | | |
|---|---|---|---|
| 3,095,266 | 6/1963 | Lauder et al. | 423/596 |
| 3,294,384 | 12/1966 | Hollefriend | 432/107 |
| 3,336,102 | 8/1967 | Hultman et al. | 423/596 |
| 3,510,256 | 5/1970 | Schafer | 423/61 |
| 3,733,389 | 5/1973 | Honbo | 423/53 |
| 4,146,975 | 4/1979 | Duhem | 432/107 |
| 4,162,295 | 7/1979 | Subbanna et al. | 423/596 |
| 4,303,477 | 12/1981 | Schmidt et al. | 588/236 |
| 5,374,408 | 12/1994 | Bruzzone et al. | 423/61 |

FOREIGN PATENT DOCUMENTS

| | | | |
|---|---|---|---|
| 420041 | 10/1925 | Germany . | |
| 91-17118 | 11/1991 | WIPO | 423/596 |

*Primary Examiner*—Steven Bos
*Attorney, Agent, or Firm*—Sprung Horn Kramer & Woods

[57] ABSTRACT

A process for the decomposition of chrome ore by alkaline oxidation by mixing finely divided chrome ore with alkaline compounds, heating the mixture in an indirectly heated rotary kiln to between 800° and 1,200° C., introducing oxygen or gases enriched with oxygen countercurrently to the mixture, wherein the mixture of chrome ore and alkaline compound is divided into a large number of individual streams, each individual stream is fed into a separate indirectly heated rotary kiln, the large number of rotary kilns is combined in the form of a bank of kilns, the theoretical distance covered by the particles of the mixture through the rotary kiln is 5 to 30 m, and the resulting average coverage of the inner surface of the rotary kiln is 1 to 5 kg of mixture/$m^2$.

3 Claims, 6 Drawing Sheets

PROCESS FOR THE DECOMPOSITION OF CHROME ORE BY ALKALINE OXIDATION

This application is a continuation-in-part of Ser. No. 08/260,865 filed Jun. 16, 1994, now abandoned.

BACKGROUND OF THE INVENTION

The present invention relates to a process for the decomposition of chrome ore by alkaline oxidation in the presence of oxygen in a rotary kiln.

The decomposition reaction with the preferred alkaline compound sodium carbonate proceeds according to the following overall reaction equation:

$$4\ FeCr_2O_4 + 8\ Na_2CO_3 + 7\ O_{2l}$$

$$\rightarrow 8\ Na_2CrO_4 + 2\ Fe_2O_3 + 8\ CO_2$$

at temperatures above 850° C.

PRIOR ART

The process is presently carried out industrially in directly heated rotary kilns of a length of 30 to 50 m and a diameter of 3 to 5 m at decomposition rates of several tons per hour.

Oxygen is introduced in the form of air, which optionally may be enriched with oxygen. The decomposition reaction mixture is heated to the required reaction temperature by the combustion of fossil fuels by means of burners arranged in the rotary kiln. Since the oxygen required for the reaction mixes with the exhaust gases, an oxygen content of only 8 to 12% is present in the kiln atmosphere. As a result long residence times of several hours of the reaction mixture in the rotary kiln are required. During the decomposition reaction intermediate liquid phases are formed which cause caking of the decomposition reaction mixture, "agglomerates" of up to 2 m in diameter sometimes being formed.

Adherence of the decomposition reaction mixture to the walls of the rotary kiln can also occur, so that the rotary kiln must literally be blasted free.

To prevent such agglomeration and adherence of the decomposition mixture, opening materials are added to the decomposition mixture in quantities which may exceed that of the chrome ore. This has an unfavourable effect both on the energy balance and the efforts required for working up the decomposition product.

Attempts were therefore made very early on to accelerate the rate of decomposition by using atmospheres with a higher oxygen content and to reduce the amount of opening materials required.

Thus in U.S. Pat. No. 3,295,954 it is proposed to carry out the decomposition in an indirectly heated kiln without contact with the exhaust gases, so as to ensure a higher oxygen content in the oxidising gases. It is further proposed to avoid agglomeration without the addition of opening materials by preventing the movement of the decomposition reaction mixture. According to this proposal, the decomposition reaction mixture is placed on fireclay slabs and passed without movement through an indirectly heated tunnel kiln.

In U.S. Pat. No. 3,733,389, it is proposed to blow oxygen-enriched air through auxiliary nozzles on to the decomposition reaction mixture in a directly heated rotary kiln, thus creating a locally oxygen-enriched atmosphere. The gases do however have a high viscosity at the prevailing temperatures, so that the oxygen-enriched air is drawn through the rotary kiln in the form of eddies and contributes little to the acceleration of the reaction.

U.S. Pat. No. 4,244,925 also already proposes the use of a kiln atmosphere of pure oxygen. This cannot however be achieved by the direct heating method preferably used in this patent, which involves the combustion of carbon-containing material.

WO 91/17 118 describes decomposition in pure oxygen in an indirectly heated rotary kiln. The tests described in the examples were carried out at rates of 7.5 to 28 kg of decomposition reaction mixture per hour, which cannot even be approximately equated with industrial dimensions. WO 91/17 118 does not provide any indication of how to apply this method on an industrial scale.

In the course of the investigations which resulted in the present invention, it was found that the decomposition of chrome ore with sodium carbonate cannot even be carried out in indirectly heated rotary kilns of less than industrial dimensions (i.e. from upwards of 10 m in length) in the absence of opening materials, since the decomposition reaction mixture becomes so highly agglomerated that the rotary kiln becomes blocked. The yield of sodium chromate is however also low when agglomerates are formed below the size at which the rotary kiln becomes blocked, since the escape of the carbon dioxide formed and the entry of oxygen into the interior of the agglomerate is impeded and, moreover, larger agglomerates have a tendency to roll in the direction of the axis of the rotary kiln and their residence times in the kiln are thus considerably reduced (compared with the average residence time of the decomposition reaction mixture) and are even insufficient for a reaction to take place in the outer layers of the agglomerates in which an exchange of gases does take place.

SUMMARY OF THE INVENTION

It has now been found that the limiting factors for the decomposition of chrome ore with sodium carbonate without the use of opening materials comprise on the one hand the coverage of the surface of the rotary kiln with the decomposition reaction mixture and on other hand the length of the distance covered by each particle of the decomposition reaction mixture in the rotary kiln at temperatures above 800° C.

The present invention thus provides a process for the decomposition of chrome ore by alkaline oxidation by

- mixing finely divided chrome ore with alkaline compounds,
- heating the mixture in an indirectly heated rotary kiln to between 800° and 1,200° C.,
- introducing oxygen or gases enriched with oxygen countercurrently to the mixture, which is characterised in that

- the mixture of chrome ore and alkaline compound is divided into a plurality of individual streams.
- each individual stream is fed into a separate indirectly heated rotary kiln,
- wherein the large number of rotary kilns is combined in the form of a bank of kilns,
- the dimensions and speed of rotation of each rotary kiln and the inclination of the axes of the rotary kilns are calculated so that the resulting theoretical distance covered by the particles of the mixture through the rotary kiln is 5 to 30 m, and each individual stream consists of such a quantity of reaction mixture—taking into account the residence time within the rotary kiln—that the resulting average coverage of the inner surface of the rotary kiln is 1 to 5 kg of mixture/$m^2$.

DETAILED DESCRIPTION

The average coverage of the inner surface area of the rotary kiln is understood to be the total quantity of decomposition reaction mixture present in the rotary kiln, divided by the total inner surface area of the rotary kiln. If 90° of the circumference of the inner surface area is covered the actual coverage of this circumferential segment is 4 times higher.

The ores used as the chrome ore have a $Cr_2O_3$ content of 40 to 47% by weight and contain as further constituents iron oxide, aluminium oxide and magnesium oxide as well as smaller amounts of silicon dioxide and other natural mineral components, typically in quantities of less than 1% by weight.

Sodium carbonate in particular is used as the alkaline compound. In addition specific amounts of sodium hydroxide and/or sodium bicarbonate can be used to influence the initial melting behaviour and to accelerate the initial reaction. In general, however, sodium carbonate is used as the only alkaline compound.

The chrome ore and the alkaline compound are used in approximately stoichiometric quantities, in accordance with the overall reaction equation mentioned at the beginning of the description. The use of a superstoichiometric quantity of alkaline compound generally does not produce a complete reaction but merely results in the discharge of unreacted alkaline compound. Since the chromium is trapped in the solid mass of the chrome ore, complete conversion to sodium chromate in industrially feasible reaction times is not generally possible. This is compensated by a corresponding reduction in the amount of alkaline compound required to slightly less than the stoichiometric amount. In view of the incomplete reaction of chromium it is desirable to use only such a quantity of the alkaline compound that it is completely reacted, without an insufficient quantity of alkaline compound being available for the maximum conversion of the chromium. Depending on the nature of the chrome ore used, the temperature in the rotary kiln and the reaction time, 90 to 97% of the chromium contained in the ore can be converted according to the present invention.

The chrome ore and the alkali compound are ground, either together or separately, to average particle sizes of between 10 and 300 μ. The particle sizes are preferably in the range between 20 and 60 μ.

According to the present invention the decomposition reaction mixture is preferably used directly, without dilution with opening materials. However, the use of opening materials in lesser quantities, for example, of up to 30 parts by weight of opening material based on 100 parts by weight of chrome ore, preferably 10 parts by weight of opening material, based on 100 parts by weight of chrome ore, is permissible according to the present invention, since the economic efficiency of the process according to the present invention is not significantly affected by this. So-called "return ore", i.e. the slag remaining after the sodium chromate has been washed, is a particularly suitable opening material.

Pure oxygen is preferably introduced into each rotary kiln of the bank of kilns according to the present invention countercurrently to the decomposition reaction mixture. The quantity of oxygen required can theoretically be limited to the oxygen required for conversion according to the overall reaction equation given at the beginning of the description. It is however advantageous to use a slight excess of oxygen to compensate for variations in time. To avoid loss of pure oxygen it is appropriate to mix the pure oxygen with a quantity of air, the amount of pure oxygen introduced being limited to the maximum stoichiometric quantity of oxygen required. According to the present invention the oxygen-containing gas should however contain at least 50% oxygen, preferably at least 80%.

The temperature in each of the rotary kilns should preferably be above 850° C. Temperatures within the range of 950° to 1,150° C. are more preferable. In order to ensure a rapid increase in temperature on the side of the entry of the decomposition reaction mixture into the bank of kilns, it is advantageous to preheat the decomposition reaction mixture to temperatures between 300° and 600° C., for example, by means of heat recovery processes. In the case of indirect heating by the combustion of fossil fuels, preheating can take place by countercurrent contact of the decomposition reaction mixture with the exhaust gases prior to introduction into the bank of kilns.

Depending on the temperature of the rotary kiln, the reaction time required for the decomposition reaction mixture for a supply of 80 to 100% oxygen is approximately 5 to 12 mins. According to the present invention this required reaction time should not be significantly exceeded, since the only slightly higher yield of sodium chromate obtainable by longer reaction times leads to a marked reduction in throughput capacity under the conditions otherwise prevailing in the process according to the present invention.

BRIEF DESCRIPTION OF THE DRAWINGS

The invention is illustrated in greater detail with the aid of the following figures.

According to the present invention, the theoretical distance covered by the particles of the mixture through the rotary kiln is understood to be the length of the path followed by a particle on its way through the kiln as a result of the interaction of the rotation of the kiln about its axis and the inclination of the axis. This path is a spiral along the inner wall of the rotary kiln, the direction of rotation of which is contrary to that of the kiln about its axis. According to the present invention this distance should not exceed 30 m. According to the present invention the preferred theoretical distance covered by each particle through the rotary kiln is 10 to 25 m. According to the present invention, only the theoretical distance covered by each particle through the rotary kiln at a temperature of above 800° C. applies. This temperature is not attained in the inlet area of the rotary kiln, especially when a decomposition reaction mixture that has not been preheated is used.

Figure 1:
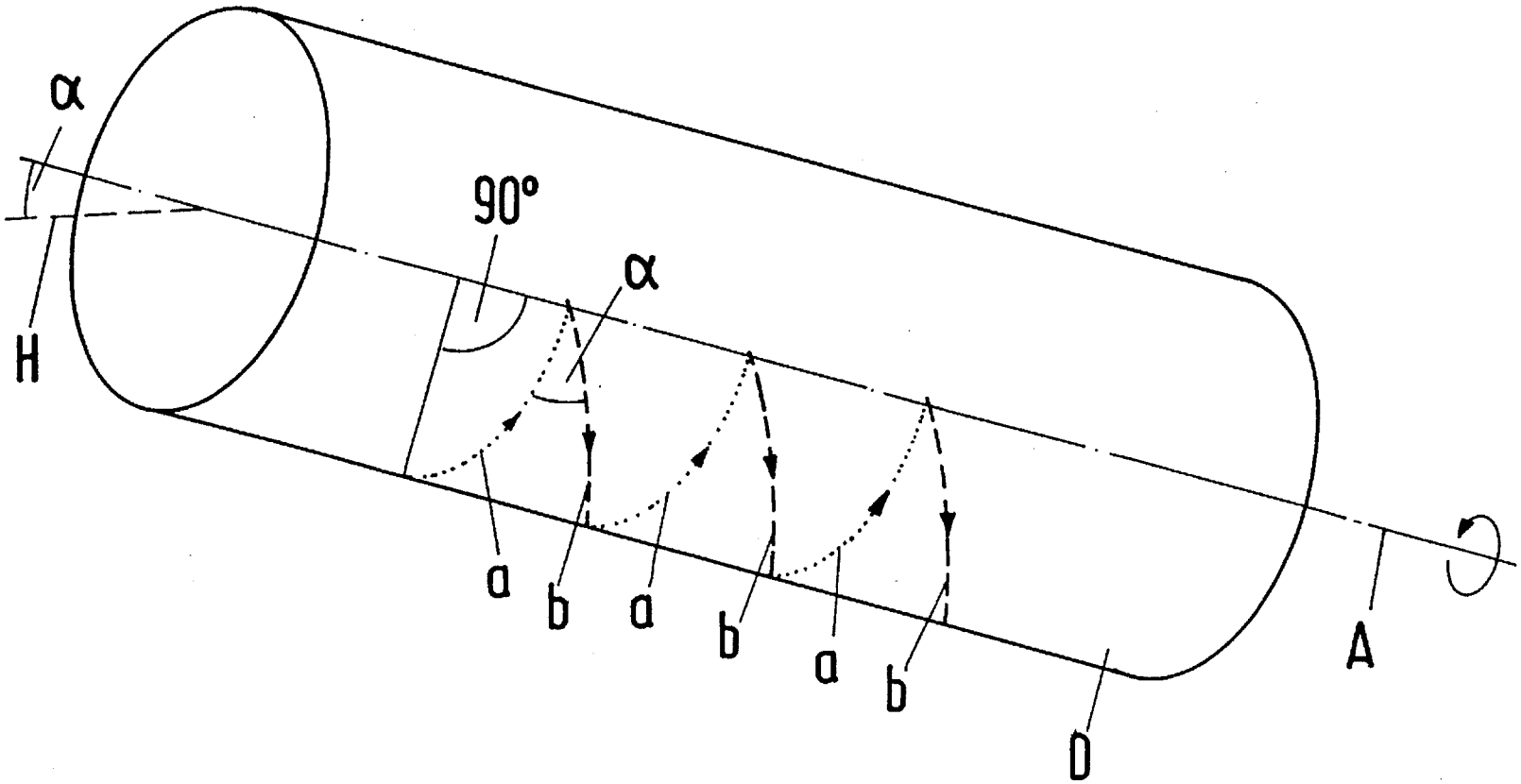
FIG. 1 illustrates the theoretical distance covered by each particle through the rotary kiln.

To illustrate the "theoretical distance covered", as it is to be understood according to the present invention, FIG. 1 shows a section of a rotary kiln D, the axis A of which is inclined at an angle α to the horizontal H. Each particle is transported upwards along the dotted line over a segment of 90° of the wall of the rotary kiln and then falls back to the lowest point along the dashed line b. The particle passes through the rotary kiln as a result of the periodic repetition of this process. The sum of all the paths b is the theoretical distance covered. Thus the theoretical distance covered can be calculated as the length of the rotary kiln divided by sin α.

Figure 2:
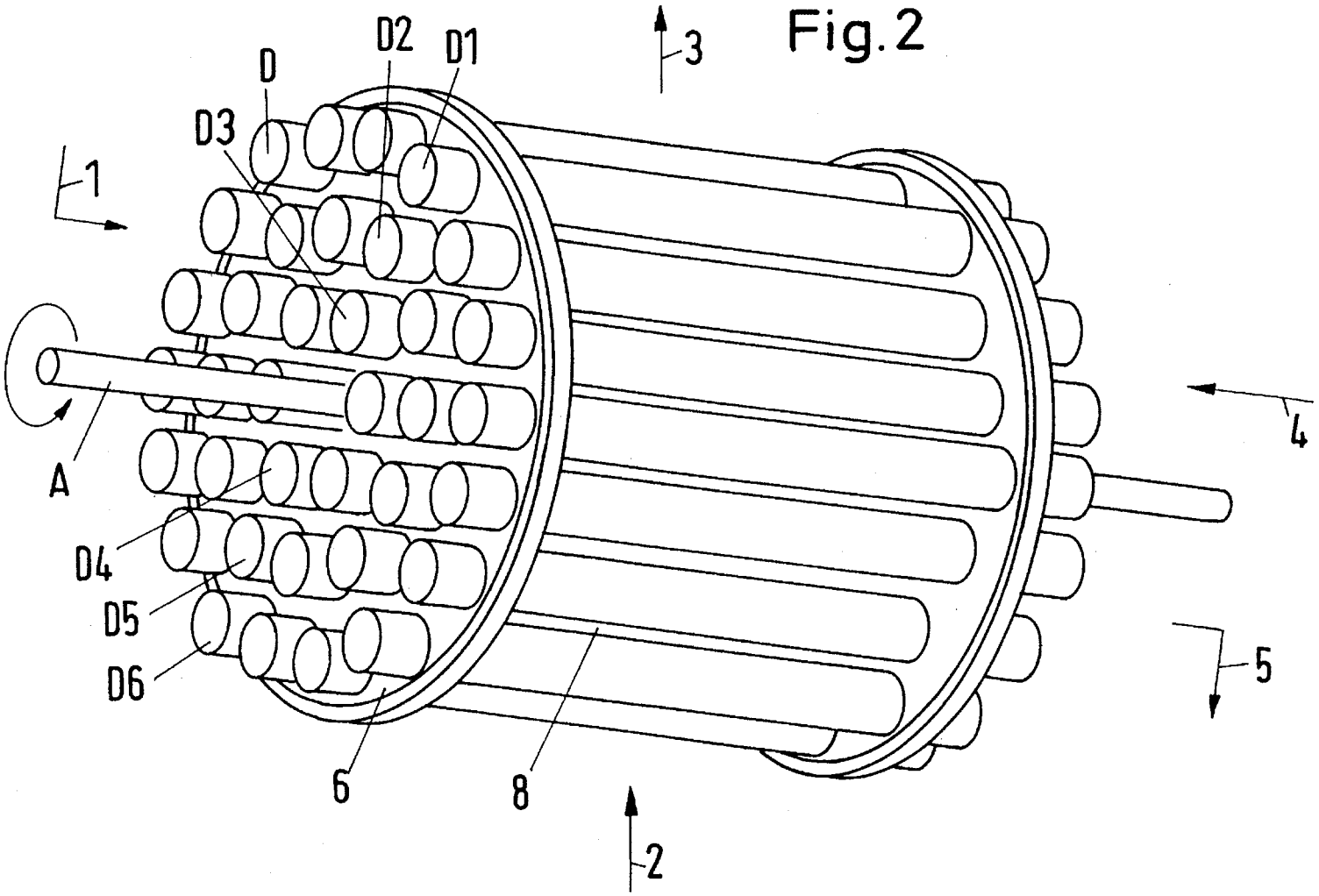
FIG. 2 shows a bank of kilns according to the present invention.

FIG. 2 shows a bank of kilns according to the present invention consisting of 36 rotary kilns, including the rotary kilns labelled D1 to D6, which are arranged about a motor-driven axis A (the motor is not shown) and held by the frames 6 and 7 which are connected to the axis A. One individual stream of decomposition reaction mixture is fed into each of the rotary kilns via arrow 1. Where hot flame gases are used for heating, burners are arranged underneath the burner, as indicated by arrow 2, said flames and hot flame gases passing through the spaces 8 between the individual kilns in the bank of kilns and heating the latter. The uniform heating of all the kilns is guaranteed by the joint rotation of the bank of kilns about axis A. The uniform heating of the kilns close to the axis compared with the kilns remote from the axis can be guaranteed by adjusting the flame length of the burner. Oxygen or oxygen-enriched air is fed into the other end of the bank of kilns via arrow 4. The decomposed material leaves the bank of kilns via arrow 5. A basin of running water is generally arranged beneath the point of exit for cooling and washing the sodium chromate. The bank of kilns is housed in a heat-insulating brick lining (not shown), the upper part of which has an outlet for the combustion gases via arrow 3. According to the invention, the bank of kilns should consist of a plurality of kilns, preferably 8 to 150, more preferably 12 to 150, and most preferably 20 to 120 kilns. Where flame-heated banks of kilns are used with more than 36 kilns, the kilns close to the axis are preferably omitted, additional burners being arranged along the axis of the bank of kilns. This will, of course, also involve a corresponding number of individual streams of chrome ore/alkaline compound mixture. In electrically-heated banks of kilns, preferably each individual kiln is provided with a heating coil, it being possible to control the individual heating means with the aid of thermostats, either separately for each kiln or for groups of kilns arranged equidistantly from the axis. Where the kilns are heated electrically, the spaces 8 between the kilns are packed with heat-insulating material.

Figure 3:
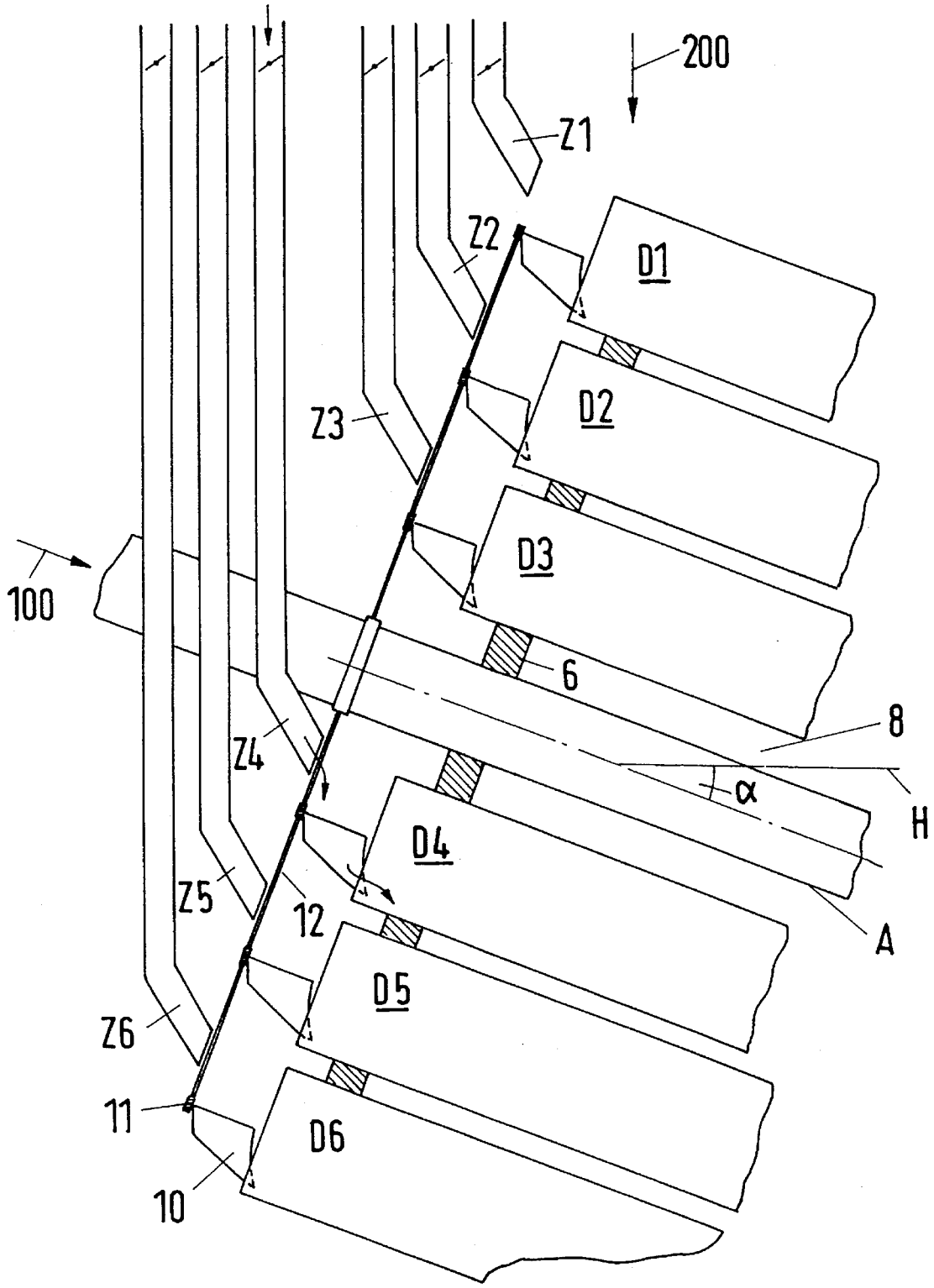
FIG. 3 shows a system for charging the bank of kilns with the decomposition reaction mixture in a view parallel to the axis of the bank of kilns.

FIG. 3 shows a section of the bank of kilns parallel to the axis A, which section includes axis A. The kilns labelled D1 to D6 to FIG. 2 are shown in FIG. 3 for the inlet region of the decomposition reaction mixture. The axis A is inclined at an angle α to the horizontal H. The angle of inclination α determines the axial path of transport of the material undergoing decomposition in each kiln during one rotation. A chute 10 is provided for each kiln which is connected by a hinge 11 to a set of rods 12. The set of rods 12 is firmly secured to the axis A and rotates with it. During the rotation of the bank of kilns, the same chute 10 consequently always remains associated with a specific kiln. Due to the forces of gravity, the chute arranged rotatably about the hinge 11, whose center of gravity is located below the rotating axis of the hinge, remains upwardly open. Additionally, supply pipes Z are provided corresponding to the number of kilns in the bank of kilns.

The supply pipes are arranged in a stationary fashion (i.e. they do not rotate with the axis of the bank of kilns) in such a manner that one supply pipe Z is always allocated to one chute 10 and provides the latter with one individual stream of decomposition reaction mixture. The figure shows supply pipes Z1 to Z6 which, in the illustrated operating state, are allocated to kilns D1 to D6 via chutes 10. Each of the supply pipes is supplied with decomposition reaction mixture via separate metering devices (not shown).

Figure 4:
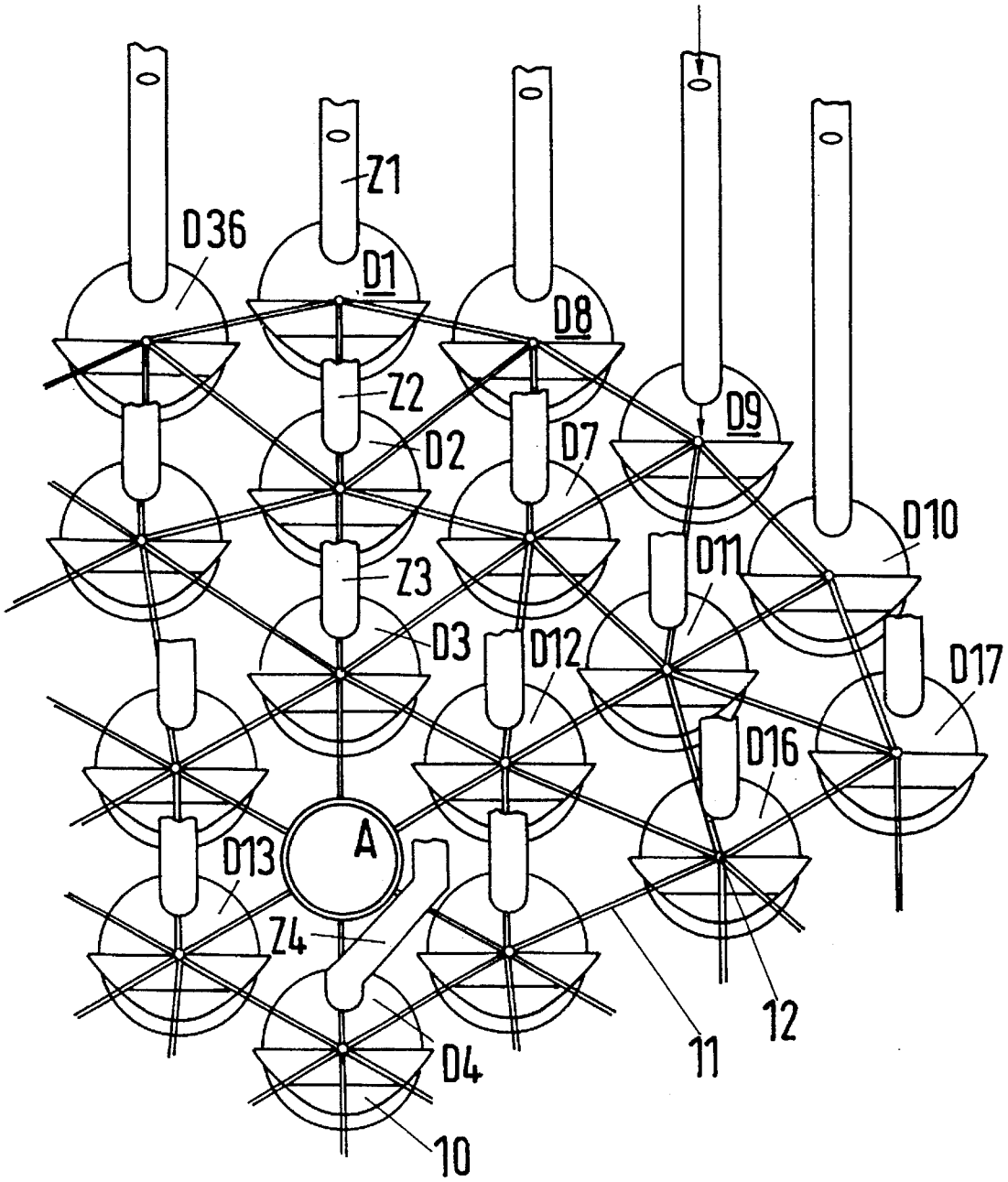
FIG. 4 shows the apparatus according to FIG. 3 but in the direction of the axis of the bank of kilns.

FIG. 4 shows a view of a section of the bank of kilns in the direction of the arrow 100 from FIG. 3. The labelling corresponds to that of FIG. 3.

Figure 5:
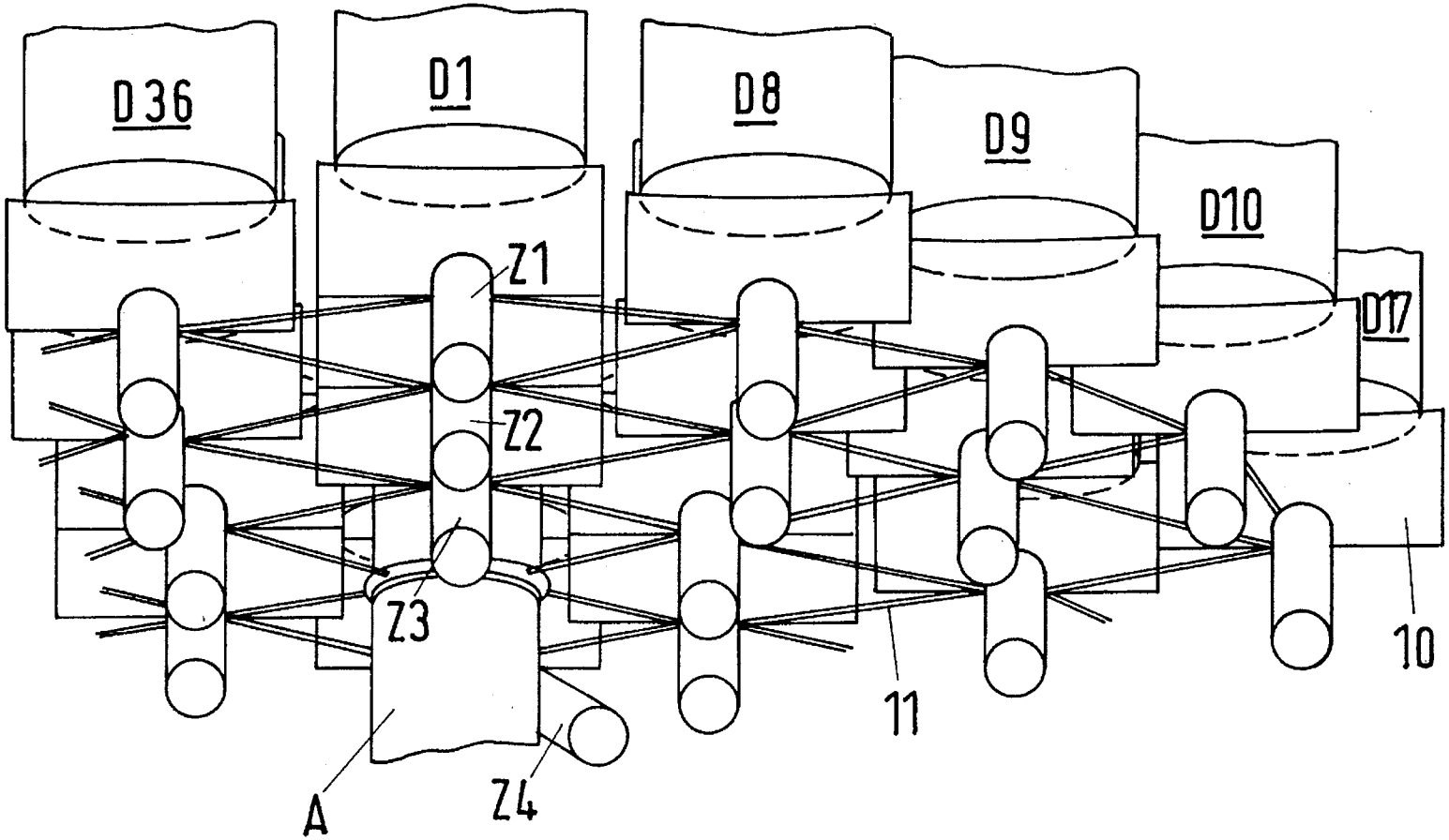
FIG. 5 shows the apparatus according to FIG. 3 but in a vertical view from above.

FIG. 5 shows a view on to a section of the bank of kilns according to FIG. 2, vertically from above on to the view according to FIG. 3 in the direction of the arrow 200 shown in FIG. 3. The periphery of the section of the bank of kilns according to FIG. 4 is shown. The numbers and letters are the same as those in FIG. 4 and label the same elements as in FIG. 4.

FIG. 5 illustrates in particular the essentially rectangular, upwardly open cross-section of the chutes 10 which intermesh in such an overlapping manner that precisely one supply pipe Z is allocated to each stationary supply pipe Z during the rotation of the chutes 10 about axis A.

Figure 6:
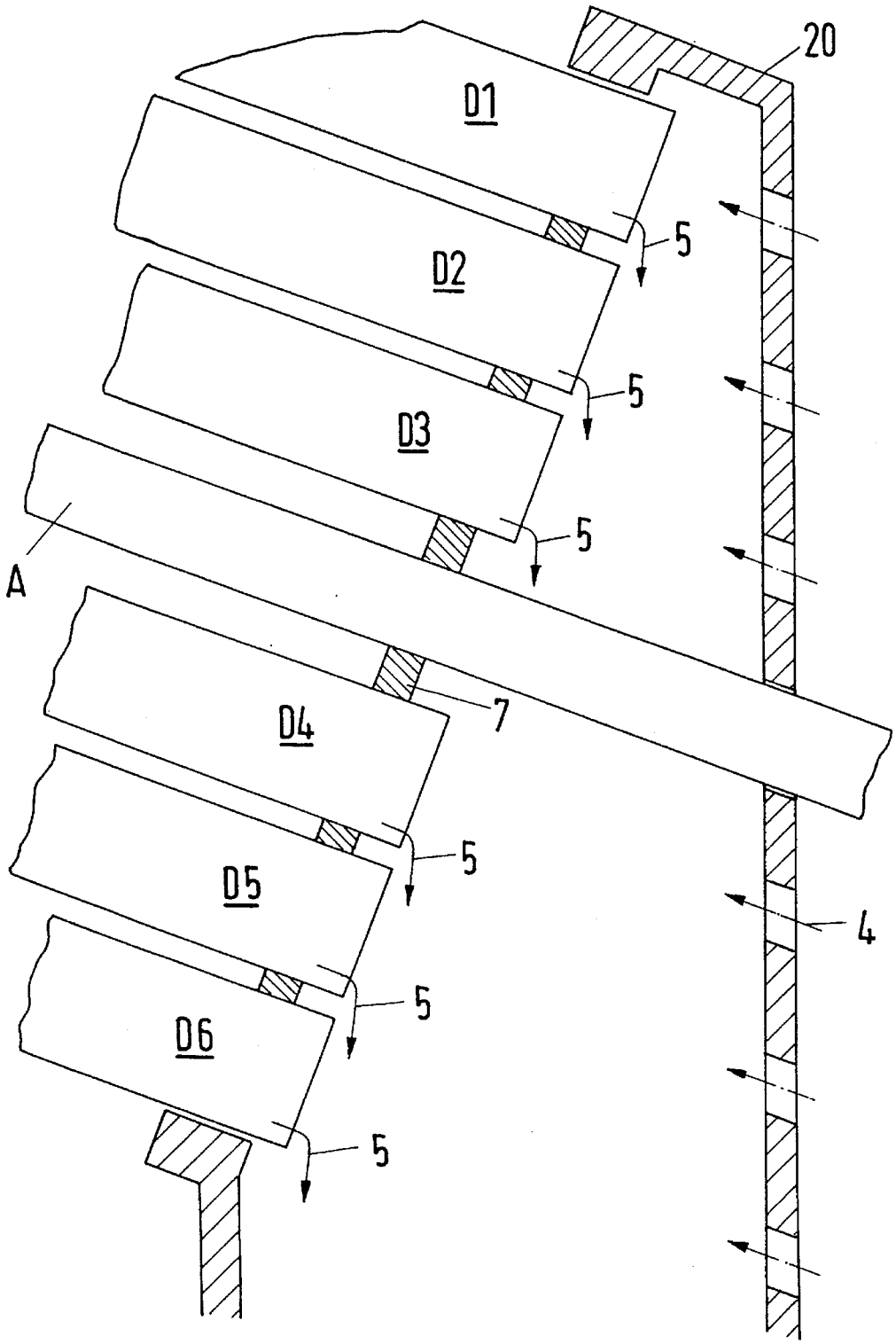
FIG. 6 shows a possible arrangement for the end at which oxygen enters the bank of kilns.

FIG. 6 shows a section of the bank of kilns according to FIG. 3 but at the other end thereof. The decomposed and oxidised chrome ore leaves the rotary kilns via arrow 5 and is passed through devices which are not illustrated into a water bath for cooling and washing the sodium chromate formed. Oxygen is introduced through the housing 20 via arrow 4.

Typical measurements for the kilns in a bank of kilns are a heated rotary kiln length of 2 to 5 m and a diameter of ⅛ to 1/12 of the kiln length. According to the present invention, depending on the dimensions of each individual rotary kiln, the axis of the bank of kilns is arranged at such an angle to the horizontal that the theoretical distance to be covered by the particles of the mixture according to the invention at a given speed of rotation about the axis results. The speed of rotation is selected according to the present invention so as to result in a residence time in the kiln of at least 7 to 15 mins, longer times resulting merely in a minor increase in the yield of sodium chromate based on the chrome ore used and generally not being used on account of the corresponding proportional reduction in the throughput capacity of the rotary kiln.

For a given residence time of the decomposition mixture in the rotary kiln determined by the dimensions of the rotary kiln, the angle of inclination of the rotary kiln axis to the horizontal and the rate of rotation, the throughput capacity of the rotary kiln is determined by the maximum surface coverage of the rotary kiln according to the invention of 5 kg mixture/$m^2$, preferably 3 kg mixture/$m^2$. The limitation of the surface coverage restricts the agglomeration of the decomposition reaction mixture in the rotary kiln so that on the one hand blockage of the rotary kiln is prevented and, on the other hand, an adequate supply of oxygen for the reaction with the agglomerate particles is ensured. The rotary kiln surface is the entire inner surface of the rotary kiln. In actual fact, the material introduced into the rotary kiln only covers an angle of 60° to 90° of the circumference of the rotary kiln.

A typical industrial plant for the decomposition of chrome ore by the process according to the present invention, with a capacity of 2.5 t of ore per hour consists, for example, of 360 kilns of a diameter of 20 cm and a heated length of 2 m, combined into 6 banks of kilns each comprising 60 kilns, it being possible for each bank of kilns to have a diameter of 2.50 m. The bank of kilns is inclined at an angle of 15° to the horizontal. Each of the individual streams fed into the individual kilns consists of 7 kg of ore and 3.4 kg of sodium carbonate per hour. The temperature in the bank of kilns is 1,070° C. The banks of kilns can advantageously be arranged radially, so that the outlet ends for the decomposed material face each other and the decomposed material is fed to a joint washing device. Given a residence time of the decomposition reaction mixture in the rotary kiln of 12 mins and a speed of rotation of 1 rotation/min, the resulting theoretical distance covered by each particle of the decomposition reaction mixture in the rotary kiln is 7.8 m. The average coverage of the inner surface area of the rotary kiln is 1.65 kg/m$^2$.

The same capacity of 2.5 t of ore per hour is obtained with a plant consisting of 2 banks of kilns each 4 m in diameter, each comprising 48 kilns 4 m in length and 0.4 m in diameter. Each kiln is charged with 26 kg of ore and 12.6 kg of sodium carbonate. At a speed of rotation of 2 mins per rotation, the residence time in the kiln is 16 mins, the distance covered through the kiln is 11 m and the surface coverage is 2 kg/m$^2$.

I claim:

1. A process for the decomposition of chrome ore by alkaline oxidation comprising forming a mixture of finely divided chrome ore and alkaline compounds, heating the mixture in an indirectly heated rotary kiln to between 800° and 1,200° C., introducing oxygen or gases enriched with oxygen into the kiln countercurrently to the mixture, wherein the mixture of chrome ore and alkaline compounds is divided into a plurality of individual streams, each individual stream is fed into a separate, indirectly heated rotary kiln, the separate rotary kilns are combined to form a bank of kilns, the dimensions and speed of rotation of each rotary kiln and the inclination of the rotary kiln axes are such that the resulting theoretical distance covered by the particles of the mixture through each rotary kiln is 5 to 30 m, and each individual stream consists of a quantity of reaction mixture such that the average coverage of the inner surface of each rotary kiln is 1 to 5 kg of mixture/m$^2$.

2. A process according to claim 1, wherein the mixture is heated to a temperature of from 950° to 1,150° C.

3. A process according to claim 1, wherein each bank of kilns consists of 20 to 150 rotary kilns.

* * * * *